US007950911B2

(12) United States Patent
Ohtsuka et al.

(10) Patent No.: US 7,950,911 B2
(45) Date of Patent: May 31, 2011

(54) SINGLE STAGE ROOT TYPE-VACUUM PUMP AND VACUUM FLUID TRANSPORT SYSTEM EMPLOYING THE SINGLE STAGE ROOT TYPE-VACUUM PUMP

(75) Inventors: Tetsushi Ohtsuka, Asaka (JP); Yosinobu Ito, Ama-gun (JP)

(73) Assignee: Sekisui Chemical Co., Ltd., Osaka (JP)

( * ) Notice: Subject to any disclaimer, the term of this patent is extended or adjusted under 35 U.S.C. 154(b) by 339 days.

(21) Appl. No.: 12/087,159

(22) PCT Filed: Dec. 26, 2006

(86) PCT No.: PCT/JP2006/325827

§ 371 (c)(1),
(2), (4) Date: Jun. 27, 2008

(87) PCT Pub. No.: WO2007/074795

PCT Pub. Date: Jul. 5, 2007

(65) Prior Publication Data

US 2009/0004039 A1 Jan. 1, 2009

(30) Foreign Application Priority Data

Dec. 27, 2005 (JP) ..... 2005-374056

(51) Int. Cl.
*F04C 2/00* (2006.01)
*F04C 28/18* (2006.01)

(52) U.S. Cl. ..... 418/32; 518/15; 518/180; 518/206.4

(58) Field of Classification Search ..... 418/15, 418/32, 180, 201.1, 206.1, 206.4, 270
See application file for complete search history.

(56) References Cited

U.S. PATENT DOCUMENTS 2,489,887 A * 11/1949 Houghton ..... 418/180
(Continued)

FOREIGN PATENT DOCUMENTS

FR 2676255 A1 * 11/1992
(Continued)

OTHER PUBLICATIONS

International Search Report issued Jan. 30, 2007 in the International (PCT) Application of which the present application is the U.S. National Stage.

*Primary Examiner* — Theresa Trieu
(74) *Attorney, Agent, or Firm* — Wenderoth, Lind & Ponack L.L.P.

(57) ABSTRACT

A single stage root type vacuum pump has a pair of outside air introduction holes formed in the vicinity of a phantom line in an inner wall surface within a range between intersecting points, where the intermediate position that is located between the center of a driving side rotor shaft and the center of a driven side rotor shaft of three-lobe rotors intersects with the intersecting points at which internal circles located on the extended circumferences of the inner wall surface of the casing. The pair of outside air introduction holes formed in symmetrical positions into horizontally long slit shapes parallel to a width direction of the casing. Check valves are fitted to tip end portions of outside air introduction pipes which are respectively connected to outside air communication holes for preventing air from escaping at the time of reverse rotation of the three-lobe rotors.

7 Claims, 8 Drawing Sheets

U.S. PATENT DOCUMENTS

| | | | | |
|---|---|---|---|---|
| 6,203,297 | B1 * | 3/2001 | Patel | 418/15 |
| 6,312,240 | B1 * | 11/2001 | Weinbrecht | 418/180 |
| 7,226,280 | B1 * | 6/2007 | Yokoi et al. | 418/206.4 |

FOREIGN PATENT DOCUMENTS

| | | | |
|---|---|---|---|
| JP | 59-203894 | | 11/1984 |
| JP | 01063676 | A * | 3/1989 |
| JP | 07-247975 | | 9/1995 |
| JP | 2684526 | | 8/1997 |
| JP | 09-236093 | | 9/1997 |
| JP | 2001-082370 | | 3/2001 |
| JP | 3571985 | | 7/2004 |
| JP | 2005-105829 | | 4/2005 |
| JP | 3702760 | | 7/2005 |

* cited by examiner

SINGLE STAGE ROOT TYPE-VACUUM PUMP AND VACUUM FLUID TRANSPORT SYSTEM EMPLOYING THE SINGLE STAGE ROOT TYPE-VACUUM PUMP

TECHNICAL FIELD

The present invention relates to a single stage root type-vacuum pump used, for example, in a vacuum sewage system for transporting sewage discharged from households, factories and the like, and to a vacuum fluid transport system employing this single stage root type-vacuum pump.

BACKGROUND ART

There are conventionally known a water seal vacuum pump and an ejector type as a vacuum generation apparatus for a vacuum station (a relay pump station) for generating a vacuum pressure to be applied to a vacuum pipeline in a vacuum sewage system.

Concerning a vacuum station 1 employing an ejector type vacuum generation apparatus, one shown in FIG. 8 has been known (see Japanese Patent No. 3702760 (paragraphs 0015 to 0032 and FIG. 1, for example)).

This station is configured so that sewage in a sewage tank 2 which is buried under a road or the like is ejected from an ejector 4 and is circulated by a sewage circulation pump 3 inside this sewage tank 2. Hence, a pressure in a vacuum sewage pipeline is maintained to be a negative pressure generated at the time of the ejection.

Meanwhile, a vacuum station employing a general water seal vacuum pump is known as a system which has high generation efficiency of vacuum and is capable of performing collection over a relatively large area.

The conventional vacuum station employing a water seal vacuum pump requires a squeeze pump in addition to the water seal vacuum pump. Accordingly, it has been difficult to make the vacuum station compact.

In this context, in a vacuum station employing a multi-stage root type-vacuum pump capable of normal and reverse rotation, an efficient use of the vacuum pump eliminates the need for a squeeze pump. Accordingly, it is possible to implement a compact vacuum station and at low cost (see Japanese Patent No. 2684526, paragraphs 0015 to 0020, FIG. 1 and FIG. 2, for example).

In such a station, a multi-stage root type-vacuum pump capable of normal and reverse rotation is used as a vacuum pump for a vacuum sewage collection and drainage system.

However, when a difference in the vacuum pressure equal to or greater than −70 kPa is generated between a suction port side and a discharge port side of this multi-stage root type-vacuum pump, it is known that a temperature of a casing on the discharge port side may rise to approximately 150° C. due to compression heat.

For this reason, in order to prevent problems attributable to the temperature rise, there is also known a multi-stage root type-vacuum pump considering a cooling method (see Japanese Patent No. 3571985 (paragraphs 0009 to 0024 and FIG. 1, for example).

However, the vacuum station 1 using the above-described conventional ejector type vacuum generation apparatus thus configured has poorer efficiency of vacuum generation than a water seal vacuum pump, and has a problem of an increase in running costs when generating a high degree of vacuum.

For this reason, the ejector type vacuum generation apparatus is generally used in a relatively small area under conditions that a degree of vacuum generation is set to be small with limitation on the collectable range of sewage.

Moreover, in the case of pumping by reverse rotation using the multi-stage root type-vacuum pump capable of performing normal and reverse rotation, a volume ratio between the two stages makes an amount of air at the time of reverse rotation become smaller than that at the time of normal rotation. Accordingly, there is a problem in that a pumping flow rate is reduced at the time of reverse rotation.

For this reason, there has been a demand for a root type-type-vacuum pump which can exert equal performances at the time of normal rotation and at the time of reverse rotation in order to shorten a discharge time of sewage or the like.

Meanwhile, in a vacuum sewage system, even in a case where a surface treatment such as coating is applied to a vacuum sewage system, such surface treatment alone is not sufficient to prevent the corrosion from progressing under the conditions that hydrogen sulfide is generated in sewage and the gas is continuously vacuumed for a long time period. Hence, the coating or the like needs to be repaired at the time of overhauling, which requires a long period of time and cannot avoid a cost increase. As a countermeasure for such a problem, there has been a demand for a root type-type-vacuum pump having an excellent anti-corrosion property.

SUMMARY OF THE INVENTION

Accordingly, an object of this invention is to provide a single stage root type-vacuum pump which can suppress an increase in an installation space while achieving a fine anti-corrosion property, and can shorten discharge time by preventing a drop in a pumping flow rate when pumping by reverse rotation, and to provide a vacuum fluid transport system employing this single stage root type-vacuum pump.

To attain the object, a single stage root type-vacuum pump according to one embodiment of the present invention is a single stage root type-vacuum pump capable of performing normal rotation and reverse rotation. The pump includes a casing on which a suction port and a discharge port are formed, and a pair of three-lobe rotors located inside this casing and each having three lobes. The pump is a single stage root type-vacuum pump configured to suck a fluid from the suction port and to discharge the fluid from the discharge port by rotating the pair of three-lobe rotors while avoiding communication between the suction port and the discharge port.

The suction port is located in a position defined by a displacement angle of 120 or more degrees of a side between the center of each rotating shaft and the suction port, relative to a phantom line connecting the centers of the rotating shafts of the respective rotors. The discharge port is located in a position defined by a displacement angle of 120 or more degrees of a side between the center of each rotating shaft and the discharge port, relative to the phantom line connecting the centers of the rotating shafts of the respective rotors. Meanwhile, enclosed spaces are provided immediately after suction of the fluid, the enclosed spaces each surrounded by adjacent lobes of a corresponding one of the three-lobe rotors and an inner wall surface of the casing in a region between the suction port side and the discharge port side. An outside air introduction hole in a horizontally long slit shape, parallel to a width direction of the casing, is provided in the vicinity of the phantom line at a peripheral wall portion on the discharge port side of the casing. Moreover, a check valve is provided on an outside air introduction pipe which is connected to the outside air introduction hole provided on a casing lid on the discharge port side of the casing.

Meanwhile, a tip end portion of a driving side rotor shaft constituting the rotating shaft of the rotor protrudes outward from the casing. A cooling fan is provided at the protruded tip end portion of the driving side rotor shaft, thus cooling down the casing or a housing provided beside the casing by the wind of the cooling fan generated by rotation.

Moreover, at least any one of the rotor, the casing, and the housing to be provided beside the casing is made of a Ni-resist cast iron-type corrosion-resistant material having a small rate of thermal expansion.

According to another embodiment of the present invention, there is provided a vacuum fluid transport system employing the single stage root type-vacuum pump.

In the single stage root type-vacuum pump configured as described above, as the outside air introduction port in the horizontally long slit shape parallel to a width direction of the casing is provided in the vicinity of the phantom line, at the peripheral wall portion on the discharge port side of the casing, time for introducing outside air is extended while enabling introduction of a large amount of outside air, thereby making it possible to operate the single stage root type-vacuum pump and to exert equal performances at the time of normal rotation and at the time of reverse rotation.

Moreover, a total displacement angle of the closed spaces each surrounded by the mutually adjacent lobes of the respective rotors and the inner wall surface of the casing is set to 240 degrees which is twice as much as the volume movement angle of 120 degrees. Thus, a moving distance of a sealed portion is increased, the sealed portion being defined by peak portions of the lobes of the rotor, and by the inner wall surface of the casing. Accordingly, an amount of internal leakage is reduced, leading to improvement in volume efficiency. Moreover, attributed to early timing of the air on the discharge port side flowing into the enclosed space, an amount of inflow of outside air is increased and a temperature rise of a vacuum pump main body is thereby suppressed.

In addition, since the pump is of the single stage type, it suffices that an installation space is smaller as compared to a multi-stage root type-vacuum pump.

Meanwhile, by providing the cooling fan at the tip end portion of the driving side rotor shaft, the casing or the housing to be provided beside the casing is cooled down by the wind of the fan generated by rotation and the vacuum pump is thereby cooled down. Hence it is possible to prevent troubles caused by a temperature rise.

By forming the casing, the rotor, and the housing with a Ni-resist cast iron-type corrosion-resistant material having a small rate of thermal expansion, it is possible to improve anti-corrosion properties thereof.

Moreover, a collectable range of sewage is expanded by applying the single stage root type-vacuum pump to a vacuum fluid transport system, and it is possible to offer a vacuum fluid transport system which can collect sewage or the like to a relatively wide area.

EXPLANATION OF REFERENCE NUMERALS

5 SINGLE STAGE ROOT TYPE-VACUUM PUMP
6 CASING
6*a* SUCTION PORT
6*b* DISCHARGE PORT
6*c* INNER WALL SURFACE (DISCHARGE PORT SIDE INNER WALL PORTION)
11 DRIVING SIDE ROOT TYPE-ROTOR SHAFT (DRIVING SIDE ROTOR SHAFT)
11*a* TIP END PORTION
18 COOLING FAN
20, 21 THREE-LOBE ROTORS (ROTORS)
22 OUTSIDE AIR INTRODUCTION HOLE
23 CASING LID BODY (CASING LID)
24 Outside Air Communication Hole
27 CHECK VALVE

DETAILED DESCRIPTION OF THE INVENTION

Next, a single stage root type-vacuum pump and a vacuum fluid transport system employing the single stage root type-vacuum pump according to the best modes for embodying this invention will be described in detail with reference to FIG. 1 to FIG. 7.

Embodiments

Figure 3:
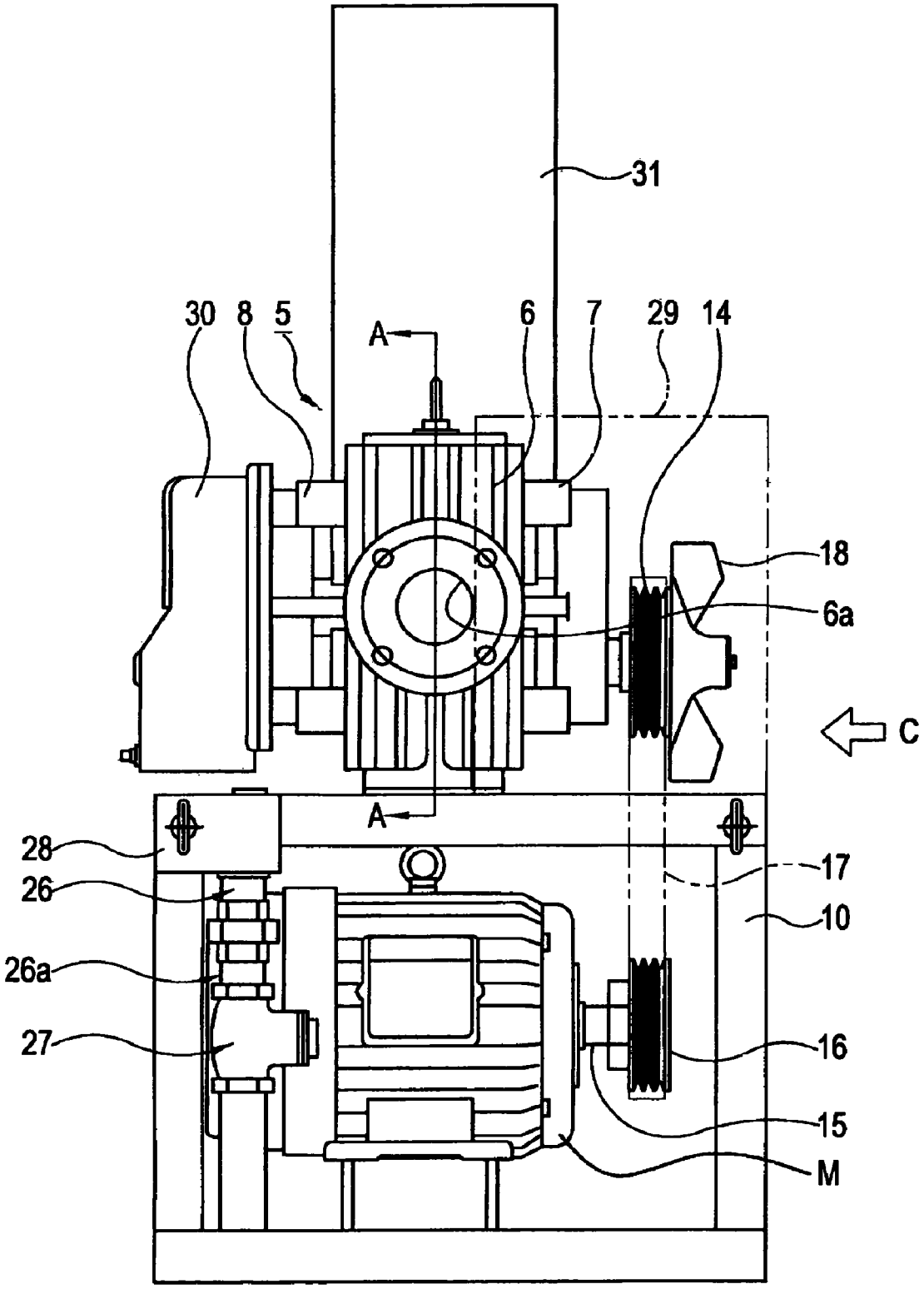
FIG. 3 is a side view for explaining an overall structure of the single stage root type-vacuum pump.
Figure 4:
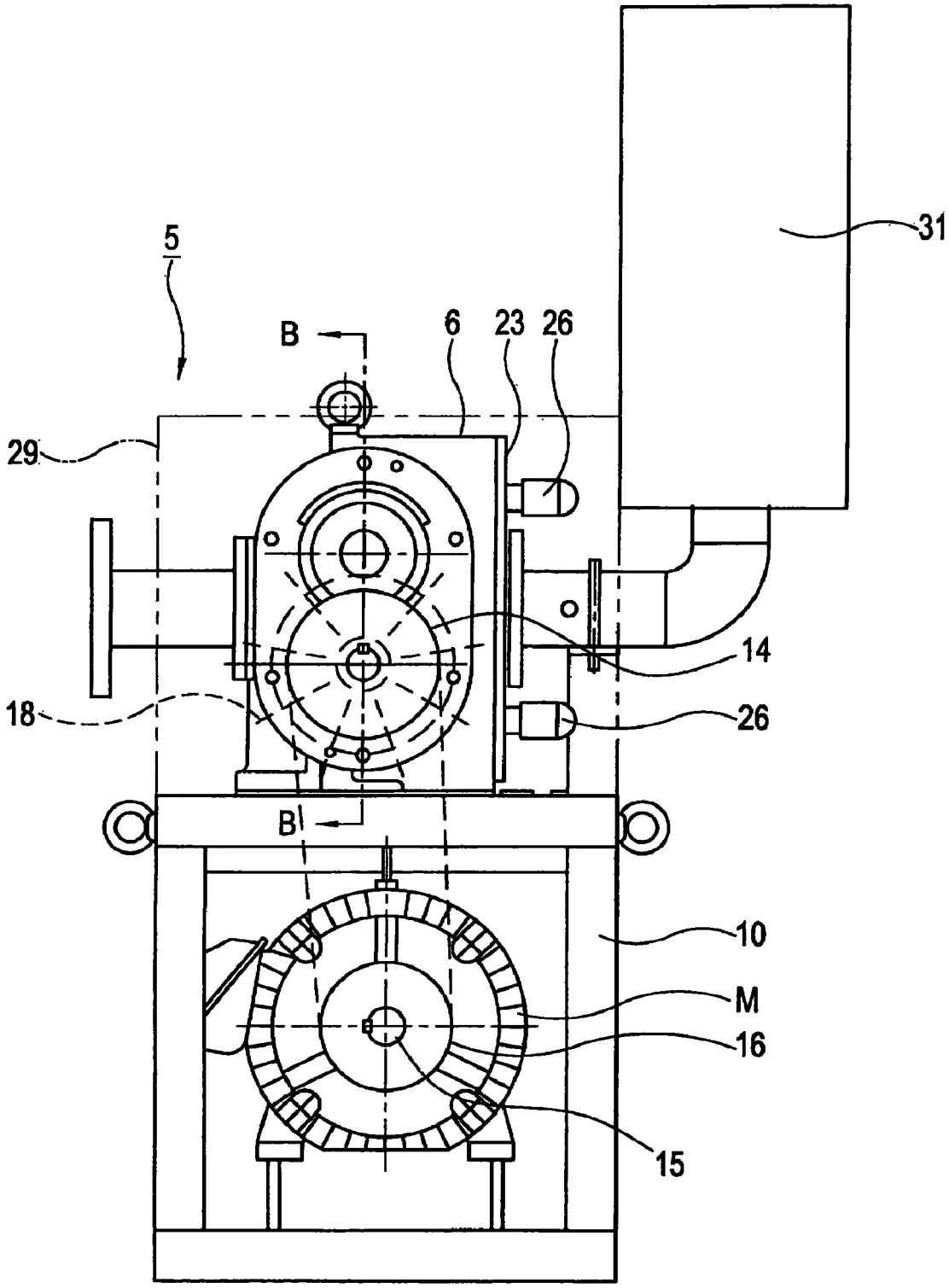
FIG. 4 is a front view for explaining the overall structure of the single stage root type-vacuum pump.

A structure of a single stage root type-vacuum pump will be explained by using FIG. 1 to FIG. 4 to begin with. A single stage root type-vacuum pump 5 is placed as the single stage root type-vacuum pump on an upper part of a set base 10 in which a driving motor M is provided as a drive force as shown in FIG. 3 or FIG. 4.

Figure 2:
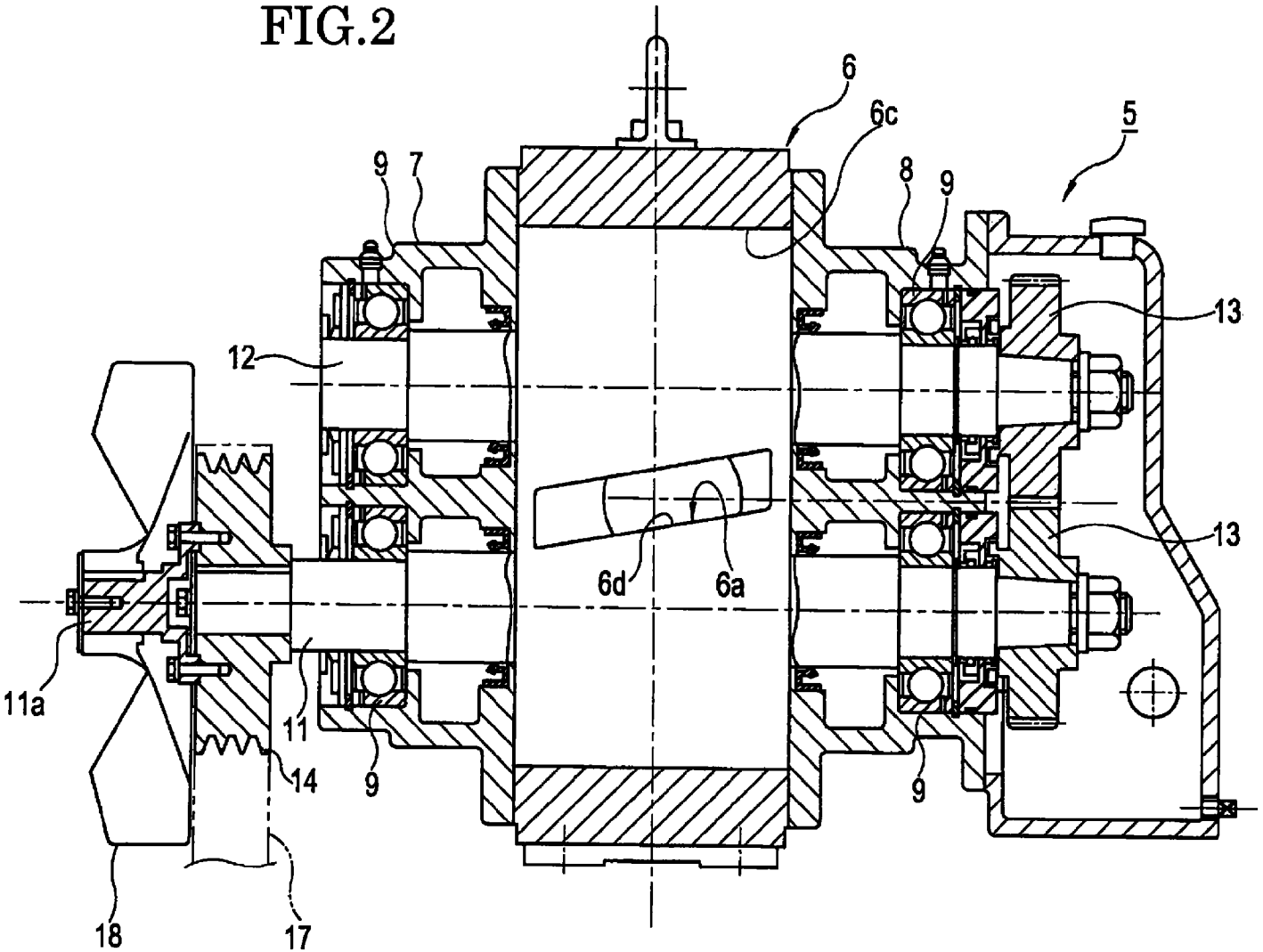
FIG. 2 is a cross-sectional view taken along a line B-B in FIG. 1 for explaining a structure omitting a three-lobe rotor portion.

As shown in FIG. 2, mainly in this single stage root type-vacuum pump 5, a pulley side housing 7 and a gear side housing 8 are fitted to both sides of a casing 6, and two parallel shafts of a driving side root type-rotor shaft 11 and a driven side root type-rotor shaft 12 are rotatably supported by bearings 9 and others which are inserted to the respective housings 7 and 8.

Meanwhile, timing gears 13 and 13 engaged with each other are fitted to respective shaft ends of the driving side root type-shaft 11 and the driven side root type-rotor shaft 12 protruding from the gear side housing 8.

Moreover, a tip end portion 11*a* of the driving side root type-rotor shaft 11 protruding from the pulley side housing 7 is provided with a motor pulley 16 that is provided on a rotating shaft 15 of the driving motor M. Additionally, a main body pulley 14 that works with the motor pulley 16 through an annular V belt member 17 is provided as well as a cooling fan 18 provided integrally and rotatably on a tip end fringe.

The casing 6 or any one of the pulley side housing 7 and the gear side housing 8 provided on respective sides of this casing 6 is configured to be cooled down by the wind from this cooling fan 18 generated by rotation of the driving side root type-rotor shaft 11.

Figure 1:
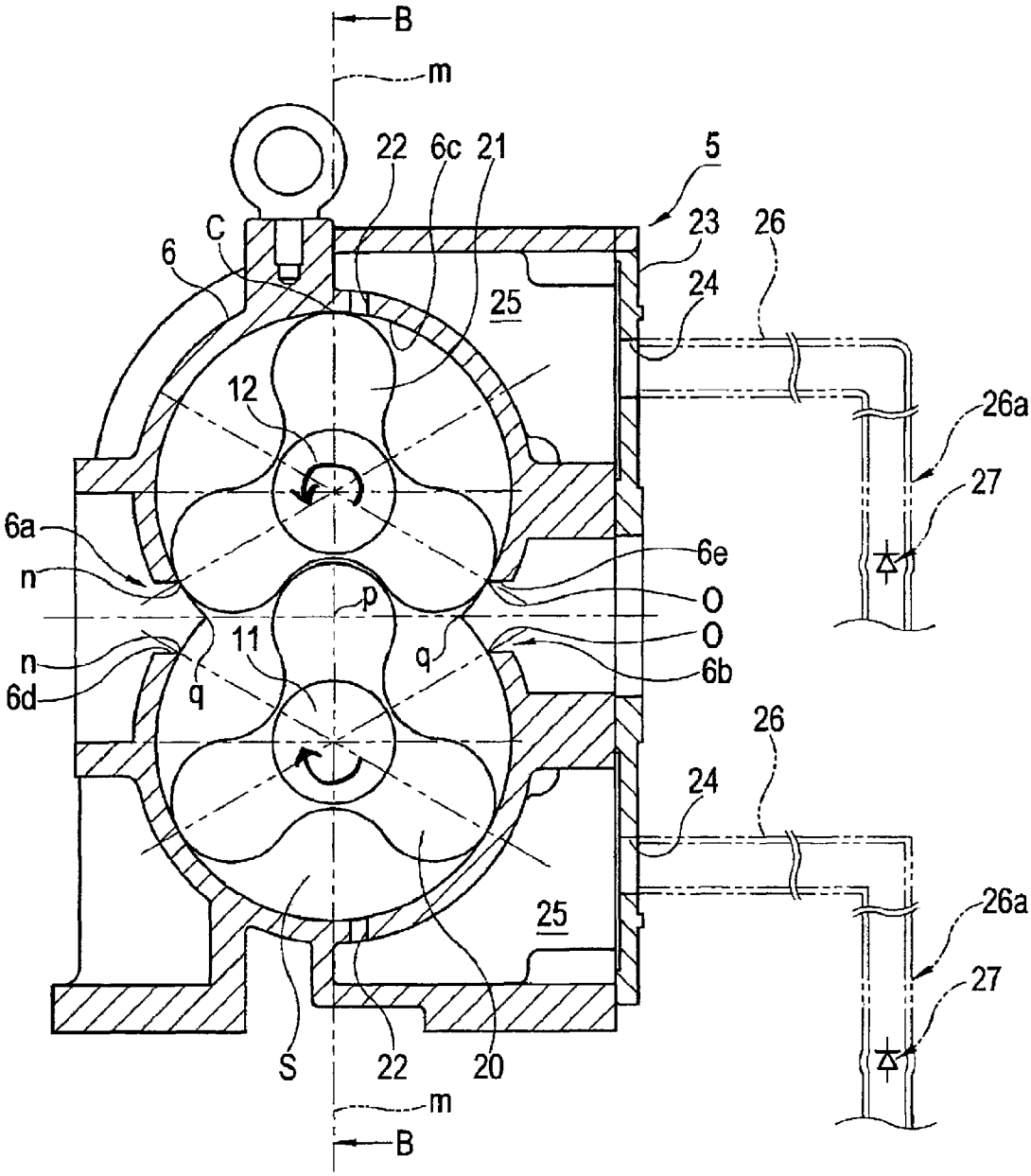
FIG. 1 is a cross-sectional view taken along a line A-A in FIG. 3 for explaining a structure of a single stage root type-vacuum pump.

Meanwhile, a pair of three-lobe rotors 20 and 21 are rotatably provided on the driving side root type-rotor shaft 11 and the driven side root type-rotor shaft 12, respectively, so as to rotate in mutually opposite directions while having a slight clearance therebetween (see arrows in FIG. 1). Each of the three-lobe rotors 20 and 21 includes three lobes.

As the three-lobe rotors 20 and 21 are rotated inside the casing 6 on which a suction port 6*a* and a discharge port 6*b* are formed as shown in FIG. 1, a fluid such as air is sucked from the suction port 6*a* and this sucked air is compressed by the three-lobe rotors 20 and 21, and then discharged from the discharge port 6*b*. Here, as is generally known, a minimum clearance C having a certain dimension is provided between an inner wall surface 6*c* of this casing 6 and each peak portion of the lobes of the respective three-lobe rotors 20 and 21.

The suction port 6*a* and a horizontally long port portion 6*d* are provided in a position exceeding a displacement angle of 120 degrees from respective centers of the driving side root type-rotor shaft 11 and the driven side root type-rotor shaft 12 relative to a phantom line m that connects the center of the driving side root type-rotor shaft 11 and the center of the driven side root type-rotor shaft 12 of the three-lobe rotors 20 and 21, or in a simple term, in positions n exceeding 120 degrees from the phantom line. The suction port 6*a* and the port portion 6*d* are disposed so as to define an angle of 10 degrees therebetween.

A pair of outside air introduction holes 22 and 22 is formed in the vicinity of the phantom line m in the inner wall surface 6*c* within a range between intersecting points q and q, where the intermediate position p is located between the center of the driving side root type-rotor shaft 11 and the center of the driven side root type-rotor shaft 12, and where the intersecting points q and q are the points at which internal circles located on extended circumferences of the inner wall surface 6*c* of the casing 6 intersect with the intermediate position (p). The pair of outside air introduction holes 22 and 22 are formed in symmetrical positions into horizontally long slit shapes parallel to a width direction of the casing.

Figure 6:
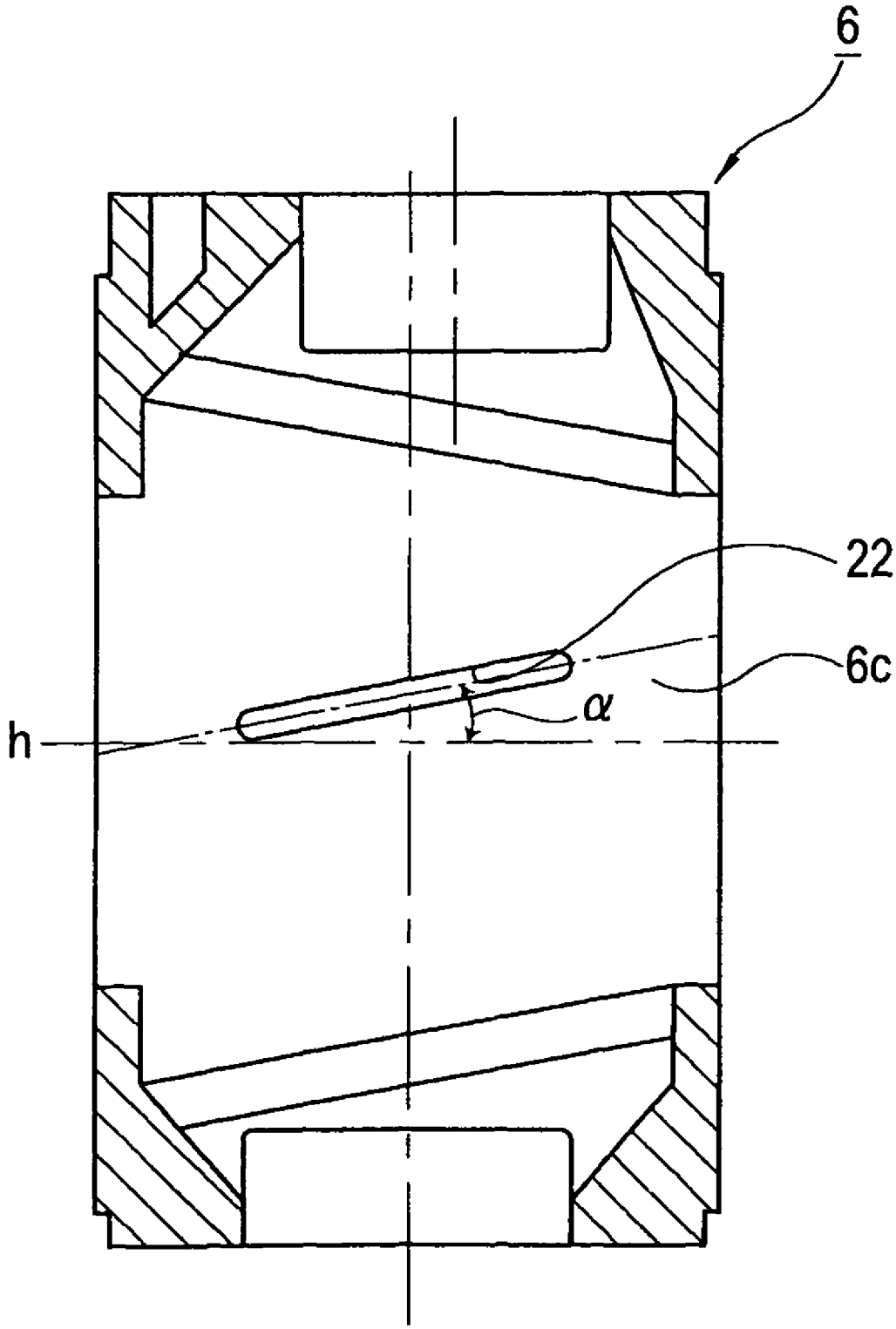
FIG. 6 is a horizontal cross-sectional view of a casing of the single stage root type-vacuum pump viewed in a direction from inside of the casing toward an inner wall surface 6*c* where an outside air introduction hole is formed.

As illustrated in FIG. 6 which is a horizontal cross-sectional view of the casing viewed from the inside thereof toward the inner wall surface 6*c* on which the outside air introduction hole 22 is formed, it is preferable to open the slit obliquely at an angle of approximately 5° relative to a horizontal line h, because explosive sound at the time of introducing outside air is reduced as compared to a case of opening the slit horizontally.

Moreover, enclosed spaces S that are surrounded by mutually adjacent lobes of each of the three-lobe rotors 20 and 21, and the inner wall surface 6*c* of the casing 6 are formed inside this casing 6.

Further, in this embodiment, outside air communication holes 24 and 24 to communicate with these outside air introduction holes 22 and 22 through internal spaces 25 and 25 are opened on a casing lid body 23 on the discharge port 6*b* side of the casing 6.

Meanwhile, check valves 27 are fitted to tip end portions 26*a* and 26*a* of outside air introduction pipes 26 and 26 which are respectively connected to these outside air communication holes 24 and 24 so as to prevent the air from escaping at the time of reverse rotation of the respective three-lobe rotors 20 and 21.

Further, in this embodiment, at least any one of the respective three-lobe rotors 20 and 21, the casing 6, and the pulley side housing 7 and the gear side housing 8 provided on both sides of this casing 6 is made of a corrosion-resistant material of Ni-resist-type cast iron having a small rate of thermal expansion equivalent to an FC/FCD material.

That is, it is most preferable to use Ni-resist D3 having a rate of thermal expansion within a range of 10 to $12\times10^{-6}/°$ C.

Moreover, safety cover members 29 and 30 are provided so as to cover the pulley side housing 7 and the gear side housing 8, respectively, and an exhaust air siren apparatus 31 is attached to a rim of the discharge port 6*b*.

Next, operations of the single stage root type-vacuum pump of this embodiment will be described.

In the single stage root type-vacuum pump of the embodiment structured as described above, a moving distance of a sealed portion defined by the peak portions of the lobes of the respective three-lobe rotors 20 and 21 and by the inner wall surface 6*c* of the casing 6 is enlarged. Accordingly, an amount of internal leakage is reduced and volume efficiency is thereby improved.

Meanwhile, attributed to early timing of the air on the discharge port 6*b* side flowing into the enclosed space S, an amount of inflow of outside air is increased and a temperature rise of a main body of the single stage root type-vacuum pump is thereby suppressed. Moreover, a cooling effect by the cooling fan 18 is added, making it possible to perform operation in a vacuum range which was not possible with a conventional single stage root type-vacuum pump.

Figure 7:
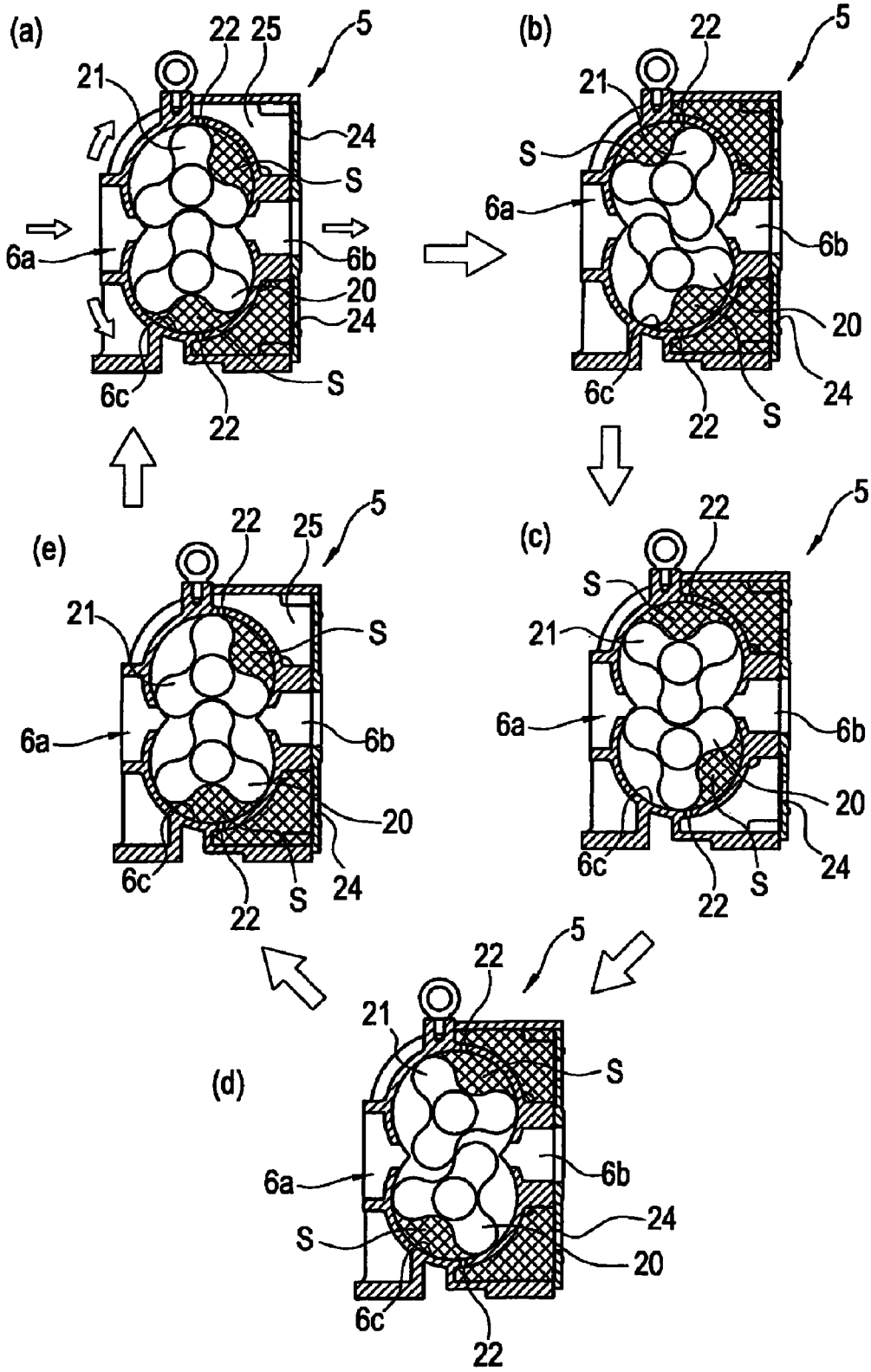
FIGS. 7(*a*) to 7(*e*) are operation explanatory views for explaining situations (a) to (e) of outside air flowing into and moving in enclosed spaces S surrounded by mutually adjacent lobes of two three-lobe rotors and the inner wall surface of the casing, the outside air flowing through outside air communication holes, internal spaces, and outside air conducting holes.
Figure 8:
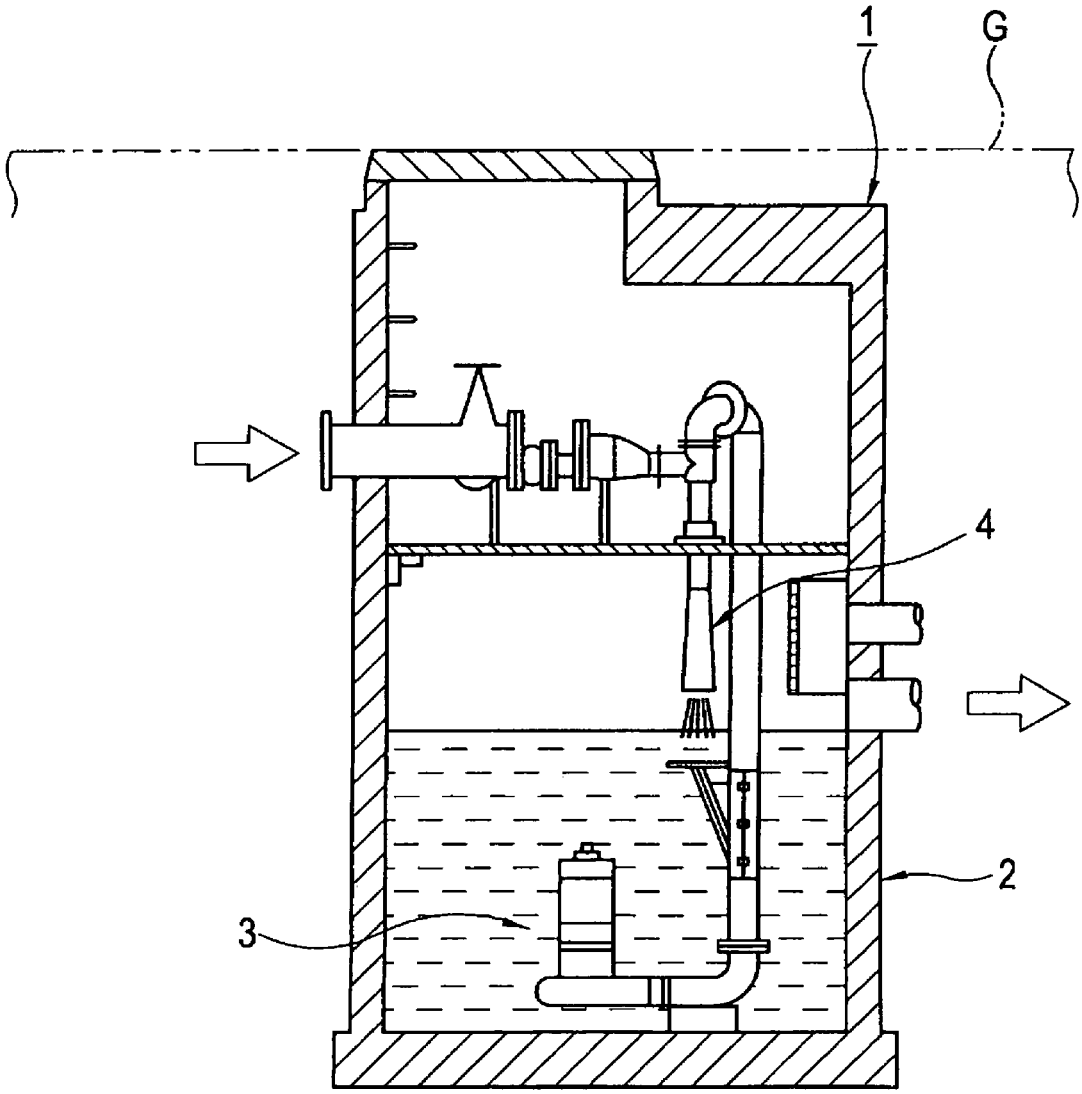
FIG. 8 is an underground vertical cross-sectional view for explaining a structure of a vacuum station using an ejector type vacuum generation apparatus of a conventional example.

For example, FIG. 7 shows situations (a) to (e) of outside air flowing into and moving in the enclosed spaces S surrounded by mutually adjacent lobes of both of the three-lobe rotors 20 and 21, and the inner wall surface 6*c* through the outside air communication holes 24 and 24, the internal spaces 25 and 25, and the outside air introduction holes 22 and 22.

In FIG. 7, shaded portions represent the outside air which flows from the outside air introduction holes 22 and 22 into the enclosed spaces S that move along with rotation of both of the three-lobe rotors 20 and 21.

Meanwhile, as shown in FIG. 3 and FIG. 4, the single stage root type-vacuum pump 5 and the driving motor M are placed in the upper and lower portions of the set base 10 and are connected together by the V belt member 17.

Since it is possible to perform vertical installation as described above, it is possible to reduce a space required for installation.

Moreover, as shown in FIG. 3, fresh outside air is introduced into the casing 6 by providing the set base 10 with an outside air introduction silencer 28 and connecting the outside air introduction pipe 26 extended from the outside air communication hole 24 formed on the casing lid body 23, with the outside air introduction pipe 26 and the check valve 27 through this outside air introduction silencer 28. Here, it is also possible to install the single stage root type-vacuum pump 5 and the driving motor M in a directly-coupled style.

Example 1

It was confirmed when applying the single stage root type-vacuum pump 5 having the above-described features to a vacuum fluid transport system including a vacuum station system, that require d time for increasing a degree of vacuum is reduced, that it is possible to extend a collectable distance of sewage, and that energy is saved.

Figure 5:
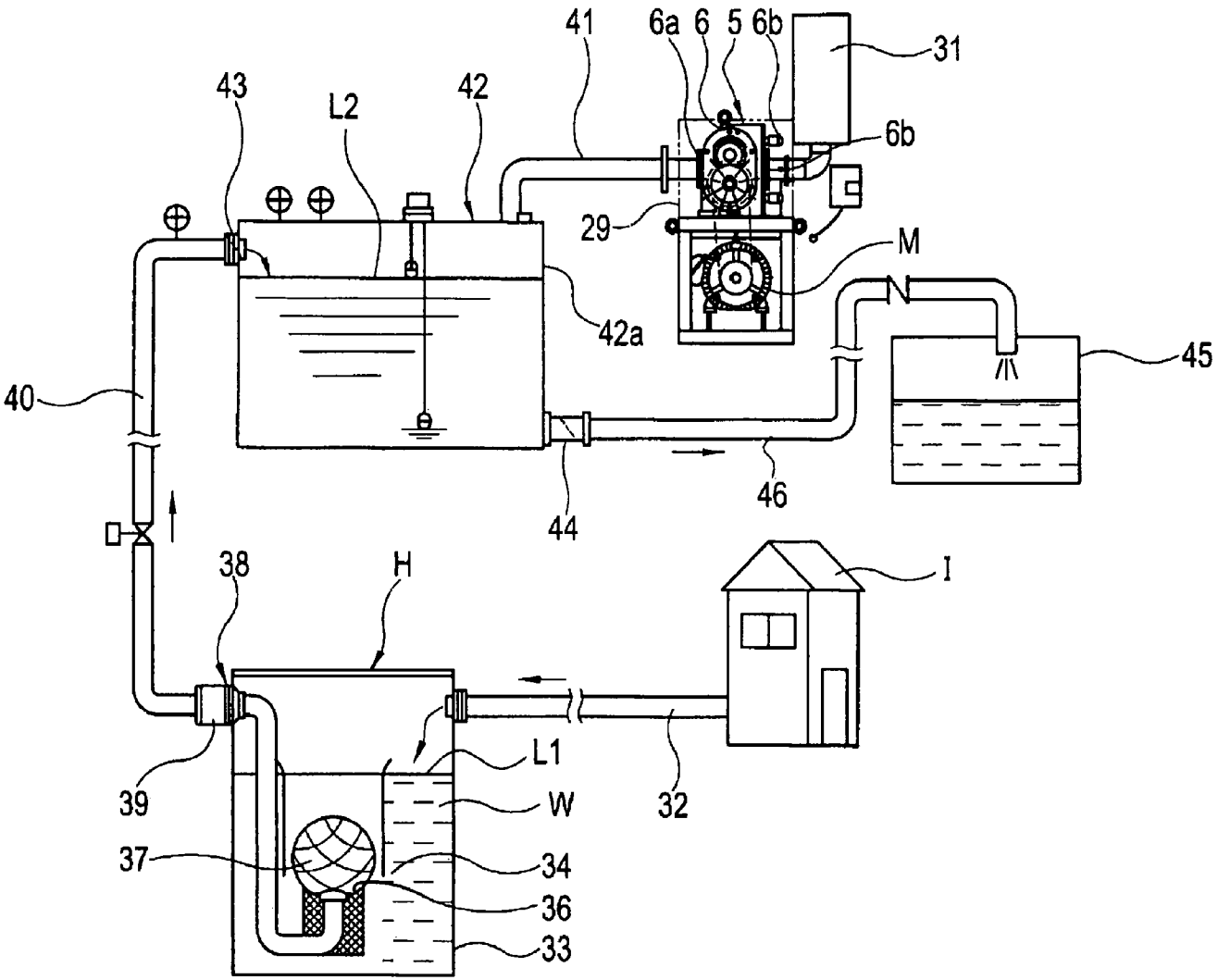
FIG. 5 is a conceptual view for explaining a structure of a vacuum fluid transport system using the single stage root type-vacuum pump according to Example 1 of the embodiment.

FIG. 5 shows a vacuum fluid transport system employing the single stage root type-vacuum pump according to Example 1 of the embodiment of this invention.

Here, explanation will be made by using the same reference numerals for identical and equivalent portions to those in the embodiment.

A structure will be explained to begin with. In the vacuum station system of this Example 1, a pipe 32 is laid for allowing sewage W, discharged from a household I or the like, to flow by gravity flow into a manhole apparatus H installed for each household or for several households.

A large float valve 34 is installed at a lower part of a cesspit 33 inside the manhole apparatus H, and a spherical float 37, configured to open a valve by buoyancy attributable to elevation of water level of the sewage W, is placed on a valve seat 36 of a valve main body 35. A vacuum sewage pipe 40 is connected to an outlet 38 of this manhole H through an exhaust valve 39.

The suction port 6*a* of the single stage root type-vacuum pump 5 is connected to a vacuum sewage collection and drainage system 42 through a pipe 41.

In this vacuum sewage collection and drainage system 42, a first check valve 43 and a second check valve 44, each of which can control opening and closing of a flow channel by control, are provided on an inlet portion and an outlet portion of a tank 42*a*, respectively. The check valves are configured to be opened and closed as appropriate in response to automatic operating actions of normal rotation drive and reverse rotation drive of the single stage root type-vacuum pump 5.

Moreover, when the vacuum sewage pipe 40 reaches a length of several kilometers, more stable functions are exerted by installing one or more smaller vacuum sewage collection and drainage systems 42 on the way.

Next, operations of the single stage root type-vacuum pump of this Example 1 and the vacuum fluid transport system using the single stage root type-vacuum pump will be described.

In the vacuum fluid transport system employing the single stage root type-vacuum pump 5 of this Example 1, the domestic sewage W discharged from the household I or the like passes through the pipe 32 and flows by gravity flow into the manhole apparatus H installed for each household or for several households.

When a water level L1 is raised by the float valve 34 inside this manhole apparatus H, the spherical float 37 floats and opens the valve main body 35. Accordingly, the sewage W is sucked into the vacuum sewage pipe 40.

As the sewage W is discharged from this cesspit 33, the spherical float 37 starts to fall and the float valve 34 is closed when the water level L1 falls close to the valve seat 36.

As described above, in the manhole apparatus H, water discharge is carried out intermittently according to the change in the level in the height direction of the water level L1 of the sewage W. Meanwhile, a groove for passing a small amount of air inside the manhole apparatus is formed in a concave manner either on a surface of the spherical float 37 or on the valve seat 36 of the float valve 34 in the manhole apparatus H. Accordingly, even when the float valve 34 is closed as the water level L1 falls close to the valve seat 36, the air containing odor is sucked into the vacuum sewage pipe 40 and a backflow phenomenon of the odor does not occur.

Meanwhile, in the vacuum sewage collection and drainage system 42, when the single stage root type-vacuum pump 5 for the vacuum station generates a degree of vacuum at −70 kPa by the normal rotation drive so that the air in an upper part of the tank 42*a* is sucked, the first check valve 43 is opened so that the sewage W inside the vacuum sewage pipe 40 flows from the inlet portion into the tank 42*a*.

When a water level L2 of the sewage W in the tank 42*a* rises and reaches an upper limit, the rise in the water level L2 is detected by an upper limit switch and the single stage root type-vacuum pump 5 is automatically switched to the reverse rotation drive.

At the time of the reverse rotation drive, the single stage root type-vacuum pump 5 functions as a press pump.

As the single stage root type-vacuum pump 5 is provided with the horizontally long outside air introduction holes 22 parallel to the width direction of the casing in the vicinity of the phantom line m on the inner wall surface 6*c* constituting a peripheral wall portion on the discharge port side of the casing 6, the time for introducing outside air is extended thereby making it possible to introduce a large amount of outside air.

For this reason, even in the case of the compact single stage root type-vacuum pump 5, it is possible to perform an operation capable of obtaining a desired pumping flow rate and to exert equal performances at the time of normal rotation and at the time of reverse rotation.

That is, compressed air is discharged to the tank 42*a* by the reverse rotation drive of the single stage root type-vacuum pump 5, whereby pressure inside this tank 42*a* becomes equal to or above 1 kg/cm$^2$.

The first check valve 43 is closed by this pressure and the sewage W is pushed downward to open the second check valve 44.

Thus, the sewage W is transported from the discharge port to a sewage treatment plant 45 through a pumping pipe 46.

Next, when the sewage W is discharged and the water level L2 inside the tank 42*a* falls, this fall in the water level L2 is detected by a lower limit switch. Then, the single stage root type-vacuum pump 5 is automatically switched to the normal rotation drive and starts sucking the air inside the tank 42*a* again as described previously.

The vacuum fluid transport system using the single stage root type-vacuum pump 5 of this Example 1 requires a smaller installation space as compared to the conventional multi-stage Root type-s vacuum pump.

Accordingly, it is possible to collect sewage and the like in a relatively wider area by downsizing and dispersing the overall vacuum sewage collection and drainage systems 42 in a collection area of sewage or the like.

Since other structures, operations, and effects are similar to those in the embodiment, explanation will be omitted.

As described above, according to the single stage root type-vacuum pump and the vacuum fluid transport system employing the vacuum pump of this embodiment, the time for introducing outside air is extended since introduction of a large amount of outside air is made possible by providing the outside air introduction holes 22 in the horizontally long slit shape, parallel to the width direction of the casing in the vicinity of the phantom line m of the peripheral wall portion, on the discharge port 6*b* side of the casing.

Hence, even in the case of the compact single stage root type-vacuum pump 5, it is possible to perform an operation capable of obtaining a desired pumping flow rate and to exert equal performances at the time of normal rotation and at the time of reverse rotation.

Moreover, a total displacement angle of the closed spaces surrounded by the mutually adjacent lobes of the respective rotors 20 and 21, and the inner wall surface 6*c* of the casing is set to 240 degrees which is twice as much as the volume movement angle of 120 degrees, whereby a moving distance of a sealed portion is increased, the sealed portion being defined by the peak portions of the lobes of the rotors 20 and 21, and by the inner wall surface 6*c* of the casing. Accordingly, an amount of internal leakage is reduced, which leads to improvement in volume efficiency.

Moreover, attributed to the early timing of the air on the discharge port 6*b* side flowing into the enclosed space, an amount of inflow of outside air is increased and a temperature rise of the vacuum pump main body is thereby suppressed.

In addition, because the pump is of the single stage type, it suffices that an installation space is smaller in comparison with a multi-stage vacuum pump.

Moreover, by providing the cooling fan 18 on the tip end portion 11*a* of the driving side Root type-s rotor shaft 11, the wind of the cooling fan 18 generated by rotation draws heat either from the casing 6 or from the pulley side housing 7 and the gear side housing 8 provided on both sides of this casing 6 and cools them down, thereby cooling down the vacuum pump.

By forming the casing 6, the respective three-lobe rotors 20 and 21, the pulley side housing 7, the gear side housing 8 and the like with a Ni-resist cast iron-type corrosion-resistant material having a small rate of thermal expansion, it is possible to improve anti-corrosion properties thereof.

Moreover, a collectable range of sewage is expanded by applying the single stage root type-vacuum pump 5 to the vacuum fluid transport system, thereby providing the vacuum fluid transport system which is capable of collecting sewage or the like in a relatively wide area.

Although the embodiment of the present invention has been described above in detail with reference to the drawings, concrete structures are not limited only to this embodiment and the present invention encompasses design changes within a degree not departing from the scope of the present invention.

Industrial Applicability

The above-described Example 1 is configured to collect the sewage from the cesspit 33 of each household I to the vacuum sewage collection and drainage system 42 provided with the single stage root type-vacuum pump 5. However, without being limited to the foregoing, any structures are acceptable as long as the single stage root type-vacuum pump 5 is applied to a conventionally-known vacuum fluid transport system, such as a structure to install the tank 42*a* below each manhole H and to disperse the respective single stage root type-vacuum pumps 5 so as to increase or decrease the pressure inside the tank 42*a* by use of each of the single stage root type-vacuum pumps 5.

What is claimed is:

1. A single stage root type-vacuum pump configured to perform normal rotation and reverse rotation, comprising:

a casing having a suction port and a discharge port spaced apart from the suction port;

a pair of three-lobe rotors located inside the casing and each having three lobes, the casing and the three-lobe rotors being configured to suck a fluid from the suction port and to discharge the fluid from the discharge port by a rotation of the pair of three-lobe rotors while avoiding communication between the suction port and the discharge port, wherein:

the suction port is located in a position defined by a displacement angle of 120 or more degrees of a side between a center of a respective rotating shaft of each of the rotors and the suction port, relative to a phantom line connecting the center of each of the rotating shafts of the respective rotors, the discharge port is located in a position defined by a displacement angle of 120 or more degrees of a side between the center of each respective rotating shaft of each of the rotors and the discharge port, relative to a phantom line connecting the center of each of the rotating shafts of the respective rotors, two enclosed spaces are provided immediately downstream of the suction port, the enclosed spaces each being surrounded by adjacent lobes of a corresponding one of the three-lobe rotors, and being surrounded by an inner wall surface of the casing in a region between the suction port side and the discharge port side, and an outside air introduction hole is provided in a vicinity of the phantom line at a peripheral wall portion on a discharge port side of the casing, the hole having a horizontally long slit shape, and being oriented parallel to a width direction of the casing, and a check valve having an outside air introduction pipe connected to an outside air communication hole provided on a casing lid on the discharge port side of the casing, the check valve being configured to prevent fluid from flowing out of the casing during reverse rotation of the rotors.

2. The single stage root type-vacuum pump according to claim 1, wherein:

a tip end portion of a driving side rotor shaft constituting the rotating shaft of the rotor protrudes outward from the casing, and a cooling fan is provided at the protruded tip end portion of the driving side rotor shaft so as to cool down any of the casing and a housing provided beside the casing due to wind of the cooling fan generated by rotation.

3. The single stage root type-vacuum pump according to claim 2, wherein:

at least any one of the rotor, the casing, and the housing to be provided beside the casing is made of a Ni-resist cast iron-type corrosion-resistant material having a small rate of thermal expansion.

4. A vacuum fluid transport system comprising the single stage root type-vacuum pump according to claim 2.

5. The single stage root type-vacuum pump according to claim 1, wherein:

at least any one of the rotor, the casing, and a housing to be provided beside the casing is made of a Ni-resist cast iron-type corrosion-resistant material having a small rate of thermal expansion.

6. A vacuum fluid transport system comprising the single stage root type-vacuum pump according to claim 5.

7. A vacuum fluid transport system comprising the single stage root type-vacuum pump according to claim 1.

* * * * *